US007342501B2

(12) United States Patent
Abbott

(10) Patent No.: US 7,342,501 B2
(45) Date of Patent: Mar. 11, 2008

(54) CLOSURE AND PACKAGE WITH INDUCTION SEAL AND RFID TAG

(75) Inventor: Douglas W. Abbott, Bowling Green, OH (US)

(73) Assignee: Owens-Illinois Healthcare Packaging Inc., Perrysburg, OH (US)

( * ) Notice: Subject to any disclaimer, the term of this patent is extended or adjusted under 35 U.S.C. 154(b) by 191 days.

(21) Appl. No.: 11/348,885

(22) Filed: Feb. 7, 2006

(65) Prior Publication Data

US 2007/0182563 A1 Aug. 9, 2007

(51) Int. Cl.
*G08B 13/14* (2006.01)

(52) U.S. Cl. ..... 340/572.8; 340/572.1; 340/568.1

(58) Field of Classification Search ..... 340/572.8
See application file for complete search history.

(56) References Cited

U.S. PATENT DOCUMENTS

| | | | | |
|---|---|---|---|---|
| 4,697,719 | A | 10/1987 | Allen | |
| 4,813,564 | A * | 3/1989 | Cooper et al. | 215/366 |
| 5,372,268 | A | 12/1994 | Han | |
| 5,381,913 | A | 1/1995 | Peeters | |
| 5,566,441 | A | 10/1996 | Marsh et al. | |
| 5,720,401 | A | 2/1998 | Moore | |
| 6,277,478 | B1 | 8/2001 | Kurita et al. | |
| 6,460,720 | B1 | 10/2002 | Massey et al. | |
| 6,471,083 | B1 | 10/2002 | Helms | |
| 6,782,601 | B2 | 8/2004 | Smeyak et al. | |
| 6,859,745 | B2 | 2/2005 | Carr et al. | |
| 7,126,479 | B2 * | 10/2006 | Claessens et al. | 340/572.1 |
| 2002/0183883 | A1 | 12/2002 | Carr et al. | |
| 2003/0061705 | A1 | 4/2003 | Smeyak et al. | |
| 2003/0235027 | A1 * | 12/2003 | Smeyak et al. | 361/679 |
| 2005/0128087 | A1 * | 6/2005 | Claessens et al. | 340/572.8 |
| 2005/0190070 | A1 | 9/2005 | Rudduck et al. | |

FOREIGN PATENT DOCUMENTS

| | | | |
|---|---|---|---|
| DE | 20105605 | U1 | 6/2001 |
| EP | 0408217 | A1 | 1/1991 |

(Continued)

*Primary Examiner*—Jeffery Hofsass
*Assistant Examiner*—Kerri McNally
(74) *Attorney, Agent, or Firm*—Reising, Ethington, Barnes, Kisselle, P.C.

(57) ABSTRACT

A package includes a container having a neck finish, and a closure having a plastic shell with a skirt externally secured to the container neck finish. A seal disk includes a metal layer on a plastic substrate. The periphery of the plastic substrate is sealingly secured to the neck finish of the container. The metal layer of the seal disk includes a circumferentially continuous outer periphery overlying the outer periphery of the plastic layer and an interrupted inner portion within said outer periphery. An RFID assembly includes and an RFID tag electrically connected to an antenna. The RFID assembly is captured between the seal disk and the plastic shell, and the interruptions in the inner portion of the metal layer of the seal disk reduce or eliminate interference in communication between the RFID assembly and external interrogation circuitry. A liner disk may be disposed between the seal disk and the RFID assembly. The closure skirt may have an internal bead to engage a periphery of the liner disk and lift the liner disk off of the neck finish during removal of the closure from the container neck finish.

17 Claims, 3 Drawing Sheets

FOREIGN PATENT DOCUMENTS

| | | | |
|---|---|---|---|
| EP | 0619243 | | 10/1994 |
| WO | WO 03/060818 | A2 | 7/2003 |
| WO | WO 2005/024745 | A2 | 3/2005 |
| WO | WO 2005/040001 | A1 | 5/2005 |
| WO | WO 2006/016184 | A2 | 2/2006 |
| WO | WO 2006/039461 | A2 | 4/2006 |

* cited by examiner

CLOSURE AND PACKAGE WITH INDUCTION SEAL AND RFID TAG

The present disclosure relates to placement of a radio frequency identification (RFID) tag in a package to identify the package or the contents of the package, or to confirm the genuineness of the package.

BACKGROUND AND SUMMARY OF THE DISCLOSURE

It is a general object of the present disclosure to provide a closure and container package that includes a seal disk induction or otherwise sealingly bonded to the neck finish of the container both to seal the package and to provide tamper indication, and an RFID tag separate from the seal disk to confirm genuineness of the package and/or to provide information concerning the product within the package, in which the seal disk has a metal layer that is constructed to minimize or eliminate interference with communications between the RFID tag and external interrogation circuitry. Another and related object of the present disclosure is to provide a closure assembly that includes such an RFID tag and seal disk adapted to be applied to and sealed to the neck finish of a container following placement of product within the container.

The present disclosure embodies a number of aspects that can be implemented separately from or in combination with each other.

A package in accordance with one aspect of the present disclosure includes a container having a neck finish, and a closure having a plastic shell with a skirt externally secured to the container neck finish. A seal disk includes a metal layer on a plastic substrate. The periphery of the plastic substrate is sealingly secured to the neck finish of the container. The metal layer of the seal disk includes a circumferentially continuous outer periphery overlying the outer periphery of the plastic layer and an interrupted inner portion within said outer periphery. An RFID assembly includes an RFID tag electrically connected to an antenna. The RFID assembly is captured between the seal disk and the plastic shell, and the interruptions in the inner portion of the metal layer of the seal disk reduce or eliminate interference in communications between the RFID assembly and external interrogation circuitry. A liner disk may be disposed between the seal disk and the RFID assembly. The closure skirt may have an internal bead to engage a periphery of the liner disk and lift the liner disk off of the neck finish during removal of the closure from the container neck finish.

A closure in accordance with another aspect of the present disclosure includes a plastic shell having a skirt for securement to a container neck finish, a seal disk within the closure, and an RFID assembly disposed between the seal disk and the plastic shell. The seal disk includes at least a metal layer and a plastic layer, with the metal layer having a circumferentially continuous outer periphery and an interrupted inner portion within the outer periphery. The RFID assembly includes an RFID tag electrically connected to an antenna. The interrupted inner portion of the metal layer reduces or eliminates interference with communications between the RFID assembly and external interrogation circuitry. The interrupted inner portion of the metal layer preferably includes an inner periphery and radial spokes connecting the inner periphery to the outer periphery of the metal layer. A liner disk may be disposed between the seal disk and the RFID assembly. The seal disk may be secured to the liner disk by an adhesion layer that is adapted to evaporate upon application of electrical energy to the metal layer to secure the seal disk to a container neck finish.

BRIEF DESCRIPTION OF THE DRAWINGS

The disclosure, together with additional objects, features, advantages and aspects thereof, will best be understood from the following description, the appended claims and the accompanying drawings, in which:

DETAILED DESCRIPTION OF PREFERRED EMBODIMENTS

Figure 1:
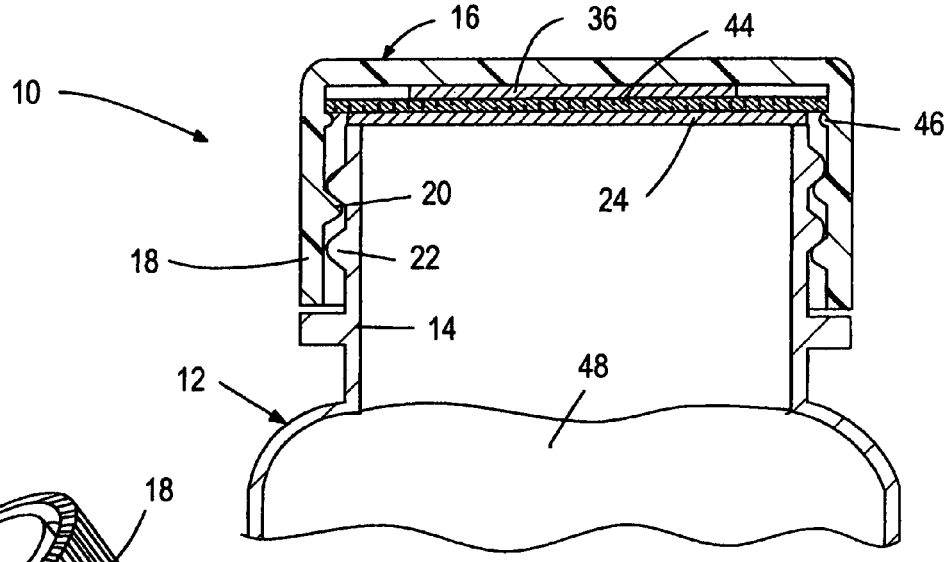
FIG. 1 is a fragmentary sectional view of a package in accordance with an exemplary embodiment of the present disclosure.
Figure 2:
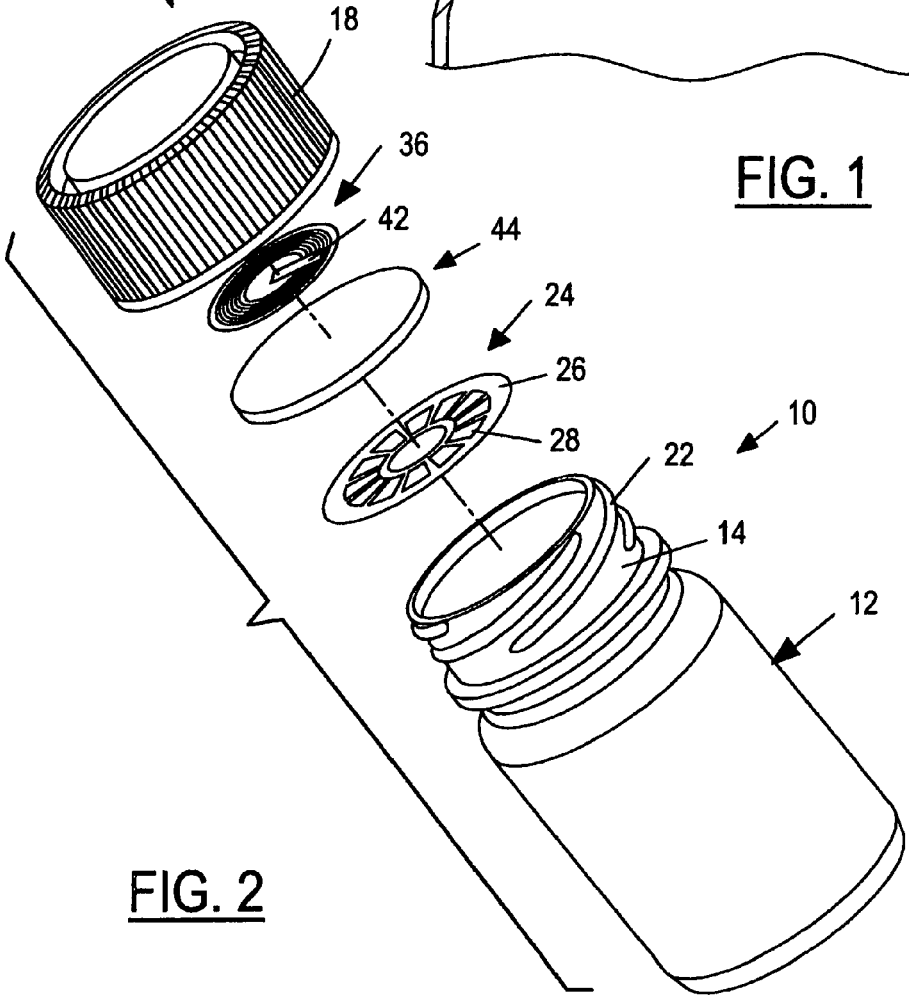
FIG. 2 is an exploded perspective view of the package illustrated in FIG. 1.
Figure 3:
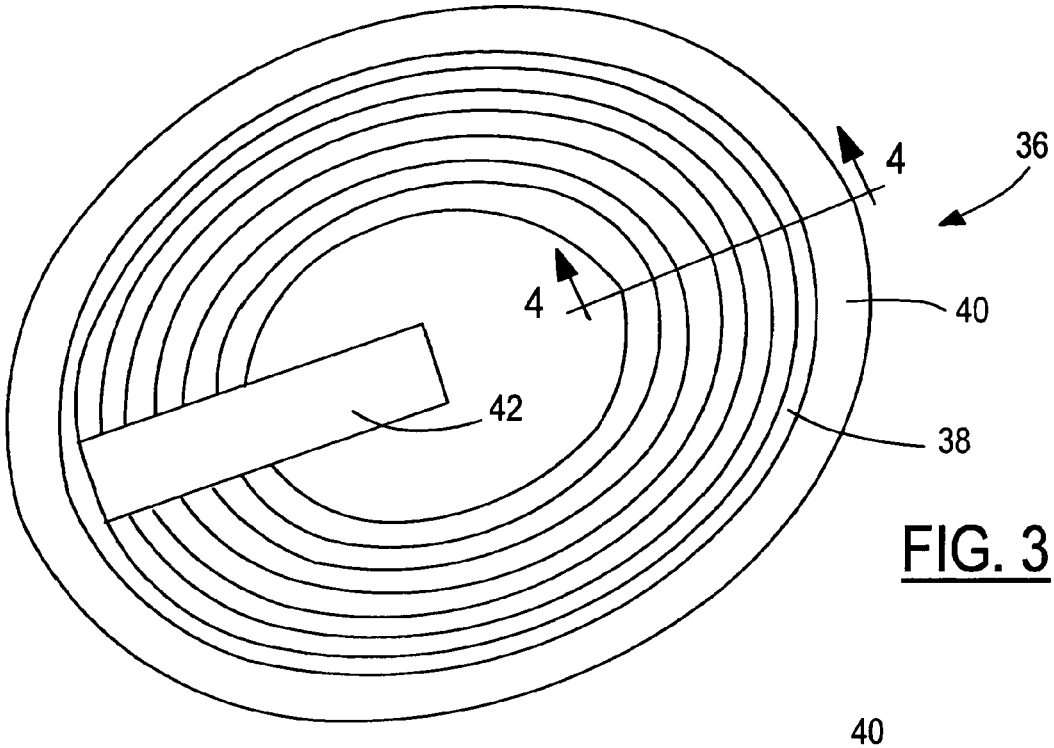
FIG. 3 is a perspective view of the RFID assembly in the package of FIGS. 1 and 2.
Figure 4:
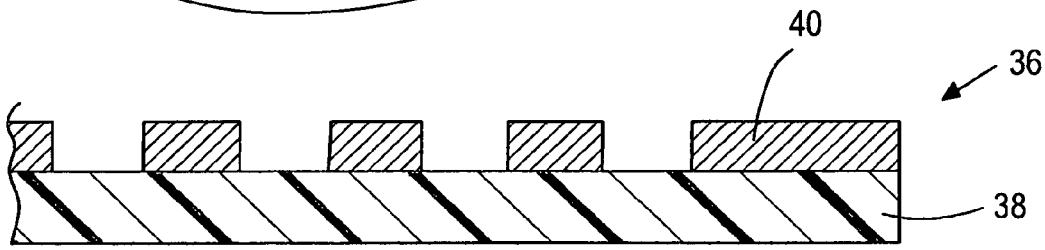
FIG. 4 is a fragmentary sectional view taken substantially along the line 4-4 in FIG. 3.

FIGS. 1-2 illustrate a package 10 in accordance with an exemplary embodiment of the present disclosure. Package 10 includes a container 12 having a neck finish 14. Neck finish 14 is illustrated as being cylindrical in the exemplary embodiment of the disclosure, but could be oval or of any other suitable geometry. Closure 16 includes a plastic shell with a skirt 18 having internal threads or beads 20 for engagement with external threads or beads 22 on neck finish 14 to secure the closure to the container. Skirt 18 preferably is cylindrical, and maybe a peripheral skirt as illustrated or an inner skirt within an outer skirt of suitable geometry such as cylindrical or oval. The closure shell preferably is of molded plastic construction. Container 12 can be of any suitable construction, such as molded plastic or glass.

A seal disk 24 (FIGS. 1-2 and 5-7) includes at least a metal layer 26 deposited or otherwise disposed on a plastic layer or substrate 28. Seal disk 24, including metal layer 26 and plastic substrate 28, preferably is of circular geometry corresponding to the preferred cylindrical geometry of container neck finish 14. Plastic substrate 28 preferably is of a material, such as polyethylene terephthalate (PET), a type of polyethylene (e.g., LDPE, MDPE or HDPE) or other suitable plastic, that can be induction bonded to the end of container neck finish 14. Metal layer 26, which may be of aluminum construction, preferably includes a circumferentially continuous outer peripheral ring 30 that overlies the periphery of substrate 28, and an inner portion that is etched or otherwise formed on substrate 28 in an interrupted pattern. In the exemplary embodiment illustrated in the drawings, the inner portion of metal layer 26 includes a ring-shaped inner periphery 32 and a plurality of radial spokes 34 that interconnect inner periphery 32 with outer periphery 30. Other interrupted geometries can be employed.

An RFID assembly 36 (FIGS. 1-4) is captured between seal disk 24 and the base wall of closure 16. RFID assembly 36 includes a substrate 38, preferably of plastic construction, and an rf antenna 40 deposited or otherwise disposed on substrate 38. Antenna 40 can be etched or otherwise formed in any suitable antenna geometry. An RFID microcircuit or tag 42 is disposed on antenna layer 40 and electrically connected to the antenna, which may be of aluminum construction for example. Thus, tag 42 can be interrogated from outside of the container through antenna 40 to obtain information from tag 42 to confirm genuineness of the package and/or to identify the product within the package such as for pricing or inventory control purposes. The structures of RFID tag 42, antenna 40 and the external circuitry for interrogating the RFID tag through the antenna can be of any suitable type known in the art. The interrupted center portion of seal disk metal layer 26 helps reduce or eliminate interference, which might otherwise be caused by seal disk metal layer 26, in communications between RFID assembly 36 and the external interrogation circuitry.

Figure 5:
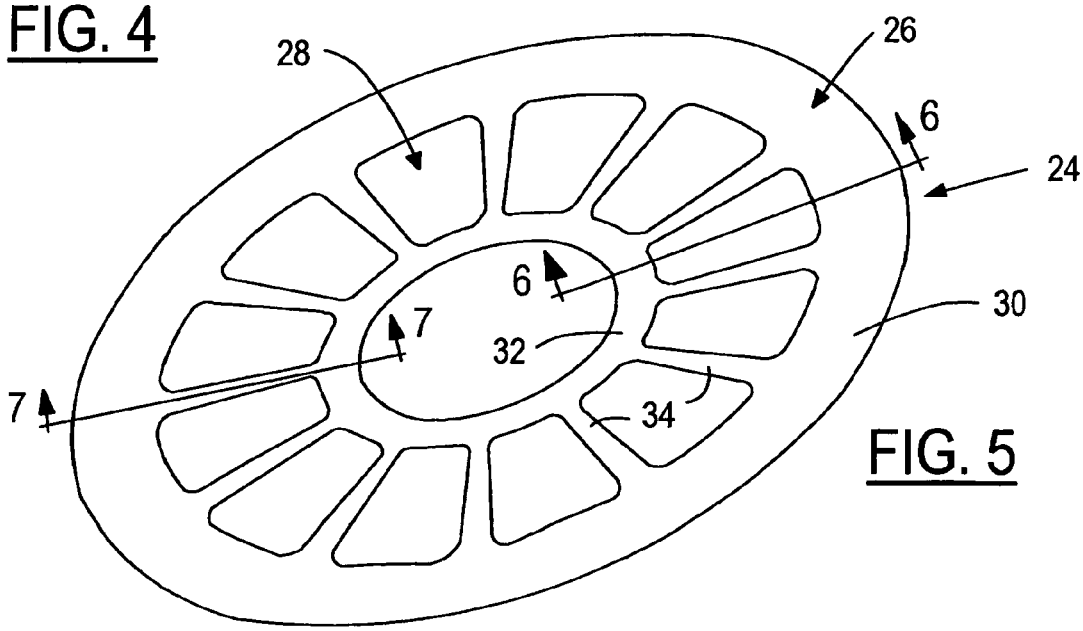
FIG. 5 is a perspective view of the seal disk in the package of FIGS. 1-2.
Figure 6:
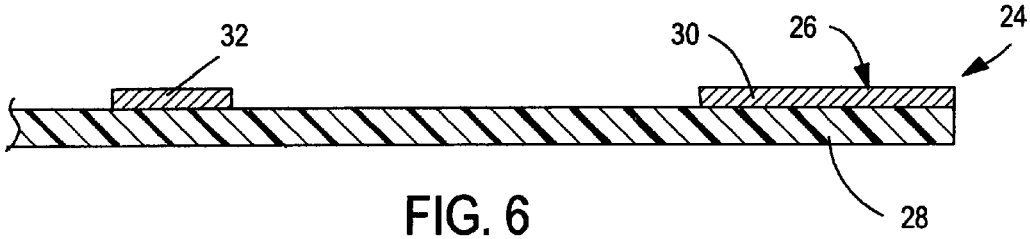
FIGS. 6 and 7 are fragmentary sectional views taken substantially along the respective lines 6-6 and 7-7 in FIG. 5.
Figure 7:
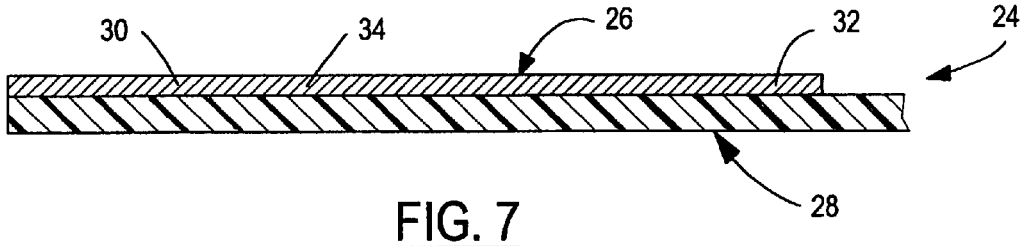

A liner disk 44 (FIGS. 1-2) optionally may be disposed between seal disk 24 and RFID assembly 36 within closure 16. Liner disk 44 may be of any suitable construction, such as cellulose, to function as a liner to seal the package after seal disk 24 has been removed. Liner disk 44 may be retained within closure 16 by means of an internal bead 46 (FIG. 1) on the closure skirt. Bead 46 can be circumferentially continuous or segmented. Liner disk 44, in addition to functioning as a package seal after seal disk 24 has been removed, also captures RFID assembly 36 within closure 16. RFID assembly 36 can be adhered to the adjacent face of liner disk 14 to facilitate placement of the RFID assembly within the closure. After placement of product 48 within container 12, seal disk 24, RFID assembly 36 and closure 16, preferably including liner disk 44, are placed over the container neck finish. Seal disk 24 is then induction bonded or otherwise secured to the end of container neck finish 14. Induction bonding is facilitated by the circumferentially continuous outer peripheral ring 30 of metal layer 26 (FIGS. 5 and 6). The closed package, including RFID assembly 36, can be interrogated to confirm genuineness of product 48 within the package or to identify the package and/or product such as by product type, lot number or the like. To open the package, closure 16 is removed from the package, preferably simultaneously removing liner disk 44 and RFID assembly 36, and seal disk 24 is ruptured to obtain access to the product within the package. Such rupturing of seal disk 24 provides a visual indication that the package has been opened, but does not impair communications with RFID assembly 36.

Figure 8:
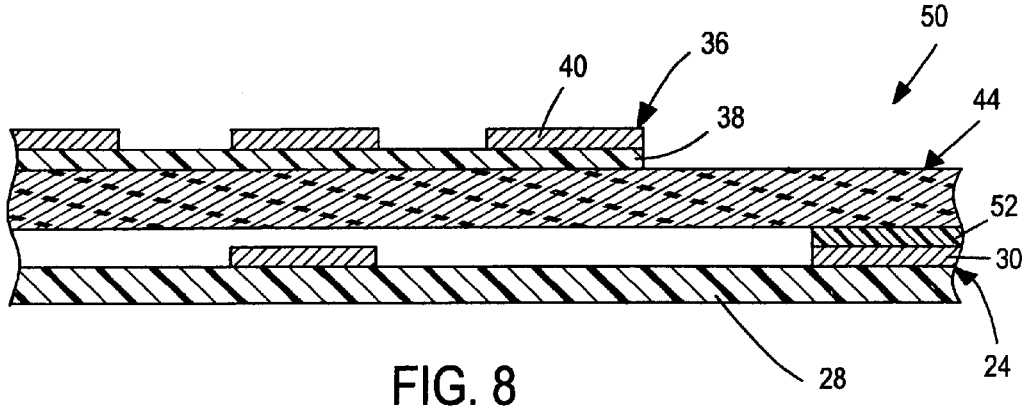
FIG. 8 is a fragmentary sectional view similar to those of FIGS. 4 and 6 but illustrating a modification to the embodiment of FIGS. 1-7.

FIG. 8 illustrates a disk assembly 50 that includes REID assembly 36 bonded to the upper surface of liner disk 44, and liner disk 44 bonded by an adhesion layer 52 at least to the outer peripheral ring 30 of seal disk 24. Adhesion layer 52 preferably is of a material, such as wax, that evaporates upon application of electrical energy to ring 30. Thus, induction bonding of seal disk 24 to the container neck finish simultaneously functions in this embodiment to separate liner disk 44 and RFID assembly 36 from seal disk 24so that the liner disk and RFID assembly thereafter are removable with the closure while leaving seal disk 24 in place on the container neck finish. This embodiment has the advantage that disk assembly 50, including RFID assembly 36, liner disk 44 and seal disk 24, can be applied in one step and liner disk 44 separated from seal disk 24 during the induction bonding operation. In the embodiment of FIGS. 1-7, seal disk 24 can be bonded to the container neck finish prior to assembly of closure 16 (with or without liner disk 36) to the container neck finish.

There thus have been disclosed a package and a closure, with an RFID tag and with a seal disk constructed to reduce or eliminate interference in communications between the RFID assembly and external interrogation circuitry, which fully satisfy all of the objects and aims previously set forth. The disclosure has been presented in conjunction with several exemplary embodiments, and other modifications and variations have been discussed. Additional modifications and variations readily will suggest themselves to persons of ordinary skill in the art in view of the foregoing description. The disclosure is intended to embrace all such modifications and variations as fall within the spirit and broad scope of the appended claims.

The invention claimed is:

1. A package that includes a container having a neck finish, and a closure that includes:

a plastic shell having a skirt externally secured to said neck finish, a seal disk that includes an electrically conductive layer on a plastic substrate, a periphery of said plastic substrate being sealingly secured to said neck finish, said electrically conductive layer including a circumferentially continuous outer periphery overlying an outer periphery of said plastic substrate and an interrupted inner portion within said outer periphery, and an RFID assembly that includes an antenna and an REID tag electrically connected to said antenna, said RFID assembly being captured between said seal disk and said plastic shell.

2. The package set forth in claim 1 including a liner disk between said RFID assembly and said seal disk.

3. The package set forth in claim 2 wherein said liner disk is separate from said seal disk.

4. The package set forth in claim 3 including an internal bead on said skirt to engage a periphery of said liner disk and lift said liner disk off of said seal disk during removal of said closure from said neck finish.

5. The package set forth in claim 2 wherein said RFID assembly is bonded to said liner disk.

6. The package set forth in claim 5 including an internal bead on said skirt to engage an outer periphery of said liner disk and lift said liner disk off of said seal disk during removal of said closure from said neck finish.

7. The package set forth in claim 1 wherein said interrupted inner portion of said metal layer includes an inner periphery and radial spokes connecting said inner periphery to said outer periphery.

8. A closure that includes:

a plastic shell having a skirt for securement to a container neck finish, a seal disk within said closure, said seal disk including at least an electrically conductive layer and a plastic layer, said electrically conductive layer including a circumferentially continuous outer periphery overlying an outer periphery of said plastic layer and an interrupted inner portion within said outer periphery, and an RFID assembly that includes an antenna and an RFID tag electrically connected to said antenna, said RFID assembly being disposed between said seal disk and said plastic shell.

9. The closure set forth in claim 8 wherein said interrupted inner portion of said electrically conductive layer includes an inner periphery and radial spokes connecting said inner periphery to said outer periphery.

10. The closure set forth in claim 8 wherein said plastic layer comprises a plastic disk substrate on which said electrically conductive layer is disposed.

11. The closure set forth in claim 10 including a liner disk disposed between said seal disk and said RFID assembly.

12. The closure set forth in claim 11 wherein said seal disk is secured to said liner disk by an adhesion layer that is adapted to evaporate upon application of electrical energy to said outer periphery of said metal layer.

13. The closure set forth in claim 12 including an internal bead on said skirt to engage an outer periphery of said liner disk and hold said liner disk within said shell.

14. A closure that includes:

a plastic shell having a skirt for securement to a container neck finish, a seal disk within said plastic shell, said seal disk including a plastic disk substrate and an electrically conductive layer disposed on said substrate, said electrically conductive layer including a circumferentially continuous outer periphery overlying an outer periphery of said plastic disk substrate and an interrupted inner portion within said outer periphery, an RFID assembly including a substrate, an antenna on said substrate and an RFID tag electrically connected to said antenna, and a liner disk disposed between said seal disk and said RFID assembly, said liner disk being secured at least to said continuous outer periphery of said electrically conductive layer of said seal disk by an adhesion layer that is adapted to evaporate upon application of electrical energy to said outer periphery of said metal layer.

15. The closure set forth in claim 14 including an internal bead on said skirt to engage an outer periphery of said liner disk and hold said liner disk within said shell.

16. The closure set forth in claim 15 wherein said interrupted inner portion of said electrically conductive layer includes an inner periphery and radial spokes connecting said inner periphery to said outer periphery.

17. The closure set forth in claim 15 wherein said RFID assembly is bonded to said liner disk.

* * * * *